US010501247B2

(12) United States Patent
Jian et al.

(10) Patent No.: US 10,501,247 B2
(45) Date of Patent: Dec. 10, 2019

(54) CONTAINER AND LOCKING MECHANISM THEREOF

(71) Applicant: SHANGHAI HONGYAN RETURNABLE TRANSIT PACKAGINGS CO., LTD, Shanghai (CN)

(72) Inventors: Yuanli Jian, Shanghai (CN); Kai Gong, Shanghai (CN); Bangping Xie, Shanghai (CN)

(73) Assignee: SHANGHAI HONGYAN RETURNABLE TRANSIT PACKAGINGS CO., LTD, Shanghai (CN)

( * ) Notice: Subject to any disclaimer, the term of this patent is extended or adjusted under 35 U.S.C. 154(b) by 234 days.

(21) Appl. No.: 15/543,811

(22) PCT Filed: Jan. 14, 2016

(86) PCT No.: PCT/CN2016/070897

§ 371 (c)(1),
(2) Date: Oct. 11, 2017

(87) PCT Pub. No.: WO2016/112862

PCT Pub. Date: Jul. 21, 2016

(65) Prior Publication Data

US 2018/0086520 A1 Mar. 29, 2018

(30) Foreign Application Priority Data

Jan. 14, 2015 (CN) ..... 2015 1 0019446

(51) Int. Cl.
*B65D 55/02* (2006.01)
*B65D 90/54* (2006.01)
(Continued)

(52) U.S. Cl.
CPC ..... *B65D 55/02* (2013.01); *B65D 19/18* (2013.01); *B65D 19/38* (2013.01); *B65D 45/16* (2013.01);
(Continued)

(58) Field of Classification Search
CPC ..... B65D 55/10; B65D 55/04; B65D 55/02; B65D 19/18; B65D 19/06; B65D 19/38;
(Continued)

(56) References Cited

U.S. PATENT DOCUMENTS

2014/0326721 A1* 11/2014 Jian ..... B65D 88/52 220/6

FOREIGN PATENT DOCUMENTS

CN 101342962 1/2009
CN 102310970 1/2012
(Continued)

OTHER PUBLICATIONS

International Search Report for international appl. No. PCT/CN2016/070897, dated Apr. 5, 2016 (4 pages, including English translation).

*Primary Examiner* — Robert J Hicks
(74) *Attorney, Agent, or Firm* — Hamre, Schumann, Mueller & Larson, P.C.

(57) ABSTRACT

A locking mechanism for locking an upper cover of a container to a side plate of the container, the container comprising a base, the upper cover and the side plate, the upper cover being provided with an edge guard; the locking mechanism comprises a lock hole formed on the exterior of at least one of the side plate and a groove formed on the upper cover; an end of the locking element is mounted in the groove; the other end of the locking element is provided with a lock; the lock passes through the edge guard and extends into the locking hole in a direction perpendicular to a direction of the side plate to securely lock the upper cover
(Continued)

to the side plate; the driving element is mounted in the groove and used to return element is mounted in the groove and used to return the mechanism, transportation and storage cost are reduced, and labor of operators is saved.

11 Claims, 23 Drawing Sheets

(51) Int. Cl.
*B65D 45/16* (2006.01)
*B65D 19/18* (2006.01)
*B65D 19/38* (2006.01)
*B65D 45/18* (2006.01)

(52) U.S. Cl.
CPC ..... *B65D 45/18* (2013.01); *B65D 90/54* (2013.01); *B65D 2519/00711* (2013.01)

(58) Field of Classification Search
CPC ..... B65D 45/18; B65D 45/16; B65D 45/22; B65D 45/00; B65D 90/64; B65D 90/54; B65D 11/1866; B65D 11/1873
USPC ..... 220/326, 324, 315, 4.33, 4.28, 7, 6
See application file for complete search history.

(56) References Cited

FOREIGN PATENT DOCUMENTS

| | | |
|---|---|---|
| CN | 103754516 | 4/2014 |
| CN | 203740414 | 7/2014 |
| CN | 104590787 | 5/2015 |
| DE | 3326353 | 1/1985 |
| EP | 2853782 | 4/2015 |

* cited by examiner

CONTAINER AND LOCKING MECHANISM THEREOF

TECHNOLOGY

The present invention relates to a container, and particularly to a locking mechanism for a container.

BACKGROUND

In general, large containers all have four side plates and a base. The large containers for transporting liquids or bulk often further have an upper cover for protection of internally loaded cargo. The upper cover is enclosed by a circle edge guard, which is close to the outer side of four side plates of the container. When the cargo inside the container applies great force to the side plates, the edge guard of the upper cover can be a certain degree of protecting the side plate from too large deformation. In addition, when the liquids or the bulk inside the container fluctuates upward, the upper cover can well limit the ups and downs of the liner bag which contains the liquids or the bulk so as to protect the liner bag from damage. This requires the upper cover to reliably connect to the box upon using. In addition, most of four side plates of the large containers can be folded in turn to reduce occupied storage space when the container is not used, thereby reducing the product turnover and storage cost.

In the existing product, there is a locking mechanism for the box and upper cover, having a crossbar with a handle which is housed in a recess provided on the upper edge of the upper cover. The side of the recess has a hole, through which crossbar stretches into the recess in the side plate of the container. When the upper cover is in use, the crossbar restricts the upper cover from moving upward from the box, and at the meantime, the handle on the crossbar is restricted moving horizontally by the ribs in the recess, so that it can be locked reliably. Although this type of design satisfies the basic connection of the upper cover and the box, when the upper cover is placed on the box and the crossbar is in the extended station, the crossbar is pressed directly to the side plate of the box and thus may be damaged as the crossbar has no return structure.

The known disclosed patent 201110295197.2 also relates to a method of locking the upper cover and box. The upper cover is provided with a groove which can accommodate a reed with a resilient sheet, the tongue of the reed can pass through the hole in the side portion of the groove and stretch out to the recess on the inner side of the container side plate. Particularly, the tongue has a slope which has a technical effect that when the upper cover is placed on the container, the pressure applied to the cover will force it to be locked on the side plate rather than damage the tongue such as in the above solution. This solution reduces the specific operating action of locking the side plate, and avoids the damage of the relevant components on the upper cover, but because of its own thicker thickness and not directly above side plates, the groove cannot be well concealed by means of the structure of the bottom of the box when the product is folded, so that the height of the stack after folded is high, which is not conducive to transport while increase the cost of storage, and when the box loads full of the liquids, the side plate suffers pressure and expand outward, which leads the depth the tongue inserts into the recess of the side plate is so shallow that the reliability of the latch is greatly reduced.

The above solution of prior art also has a common drawback, that is upon unlocking, operator is required to go to the side plate where two latches are located respectively so as to operate unlocking respectively, which need heavy workload for the operator.

SUMMARY

The object of the present invention is to provide an mechanism for enabling unlocking of both sides of the container by operating either side upon unlocking.

In order to achieve the above object, the present invention provides a locking mechanism for locking an upper cover of a container to side plates of a container which comprises a base, the upper cover and the side plate, the upper cover is provided with an edge guard, wherein the locking mechanism comprises a locking element, a driving element, a return element, a lock hole formed on an exterior of at least one of the side plates and a groove formed on the upper cover, wherein one end of the locking element is mounted in the groove, and the other end of the locking element is provided with a locking head, which passes through the edge guard and extends into the locking hole in a direction perpendicular to the side plates so as to securely lock the upper cover to the side plates, and the driving element is mounted in the groove and used to drive the locking element to be unlocked, and the return element is mounted in the groove and used to return the driving element after being unlocked.

Preferably, the upper cover is further provided with a locking element hole, through which the locking element connects to the driving element, and one end of the return element bears against the side wall of the groove of the upper cover, and the other end cooperates with the driving element.

Preferably, the return element is a spring.

Preferably, the driving element is provided with a top pillar; and the locking element is composed of a first portion and a second portion, which are integrally connected and perpendicular to each other, a top pillar receiving hole for accommodating the top pillar is provided on the first portion, and a locking head is provided on a side of the second portion facing to the side plate; and the upper cover is provided with a locking element hole, and the first portion of the locking element passes through the locking element hole and is partially located in the groove.

Preferably, the upper surface of the upper cover has an upwardly projecting portion, and the locking mechanism is provided on the side plates and the upper cover corresponding to the projecting portion.

Preferably, a locking head hole is provided at a position of the edge guard corresponding to the locking head hole, wherein the locking head passes through the locking hole and extends into the lock hole of the side plates when it is required to lock the upper cover to the side plates, so as to lock the upper cover to the side plates.

Preferably, the driving element is also provided with a latch, and the first portion of the locking element is further provided with a latch hole, and the lath inserts into the latch hole, so as to fix the driving element on the locking element.

Preferably, the locking head has an inclined plane, and the side plates has a slope above the lock, and when the upper cover is mounted on the side plates, the inclined plane cooperates with the slope.

Preferably, the driving element has a buckle position.

Preferably, a protruding piece is provided on both sides of the groove.

Preferably, the groove further comprises a spring slot, which has a step inside for bearing against end of the spring and leaving a space so that the top pillar can enter into the spring slot and connect to the spring.

Preferably, the driving element is provided with an anti-theft slot, and the upper cover structure is provided with an anti-theft hole, and the locking mechanism is further provided with an anti-theft element, and the anti-theft element is partially mounted in the anti-theft groove, and partially mounted in the anti-theft hole.

Preferably, the anti-theft element is provided with a rearward member and a high rib, and an annular groove is provided surrounding the rearward member, and one side of the annular groove is provided with a thin rib which is easily broken, and the other side is provided with a whole thin wall so that when the thin rib is torn, the rearward member is separated from the anti-theft element body and overturns to a certain degree with the thin well.

Preferably, the rearward member has a V-shaped rearward.

Preferably, the anti-theft element is further provided with at least one rib for operating conveniently.

One end of the driving element is rotatably connected to the bottom of the groove, and the other end of the driving element cooperates with the locking element so that rotation of the driving element will drive the locking element to be unlocked.

Preferably, one of the driving element and the groove is provided with a shaft, and the other one of the driving element and the groove is correspondingly provided with a shaft hole, when the driving element is mounted in the groove, the shaft hole cooperates with the shaft, so as to drive the driving element to be rotated around the shaft and thus to be unlocked.

Preferably, the other end of the driving element is provided with a top pillar, and the locking element is provided with a top pillar receiving hole, and when the driving element is mounted in the groove, the top pillar is accommodated in the top pillar receiving hole so as to connect the driving element and the locking element, and the return element is a resilient piece integrally formed on the side wall of the driving element toward the outside of the container.

Preferably, the driving element is provided with a shaft hole, and a shaft is provided within the groove, and a shaft stand is provided at the top of the shaft, and a limit step is provided above the shaft hole, and when the driving element is mounted in the groove, the shaft stand cooperates with the limit step.

Preferably, a hook is provided on the driving element, and a stand is provided in the groove, and when the driving element is mounted in the groove, the stand cooperates with the hook.

Preferably, the stand and the hook are provided with an curved shape with a axis of the shaft.

Preferably, the driving element is provided with a buckle portion, and the shaft hole is located on one side of the buckle portion, and the hook is located on the other end of the buckle portion.

Preferably, a shaft hole is provided on the driving element, and a shaft is provided in the groove, and when the driving element is mounted in the groove, the shaft hole cooperates with the shaft, so as to drive the driving element to be rotated around the shaft and thus to be unlocked.

Preferably, the driving element is also provided with a buckle portion for holding conveniently and a shrapnel for returning the driving element after the element being operated to be unlocked.

Preferably, the driving element is provided with a hook, and a stand is provided in the groove, and after the driving element is mounted in the groove, the hook cooperates with the stand so as to restrict the driving element from being disengaged outwardly.

Preferably, a shaft stand is provided on the shaft, and a shaft step is provided above the shaft hole, and after the driving element is mounted in the groove, the hook cooperates with the shaft stand so as to restrict the driving element from being disengaged outwardly.

Preferably, the driving element is also provided with an anti-theft buckle groove for mounting the anti-theft element.

Preferably, the side plates are foldable relative to the base.

According to another aspect of the present invention, there is also provided a container, comprising a base, an upper cover and a side plate, wherein the upper cover is provided with edge guard, and an upwardly projecting protrusion is provided on the upper surface of the upper cover, and the above said locking mechanism is provided on the side plate and the upper cover corresponding to the projecting portion.

Preferably, two locking mechanisms are respectively provided on opposite sides of the container.

The locking mechanism of the present invention not only allows the upper cover to be automatically locked upon compressing but also locates above the edge of the upper cover and the side plate compactly, which facilitates reducing the height of the stack after the box is folded, reducing transportation and storage costs, and at the same time the box is full loaded and the side plates are drummed out, making the locking reliability stronger, and unlocking the upper cover only by one side operation, which reduces the amount of labor of the operator.

DETAILED DESCRIPTION OF THE EMBODIMENTS

Figure 1:
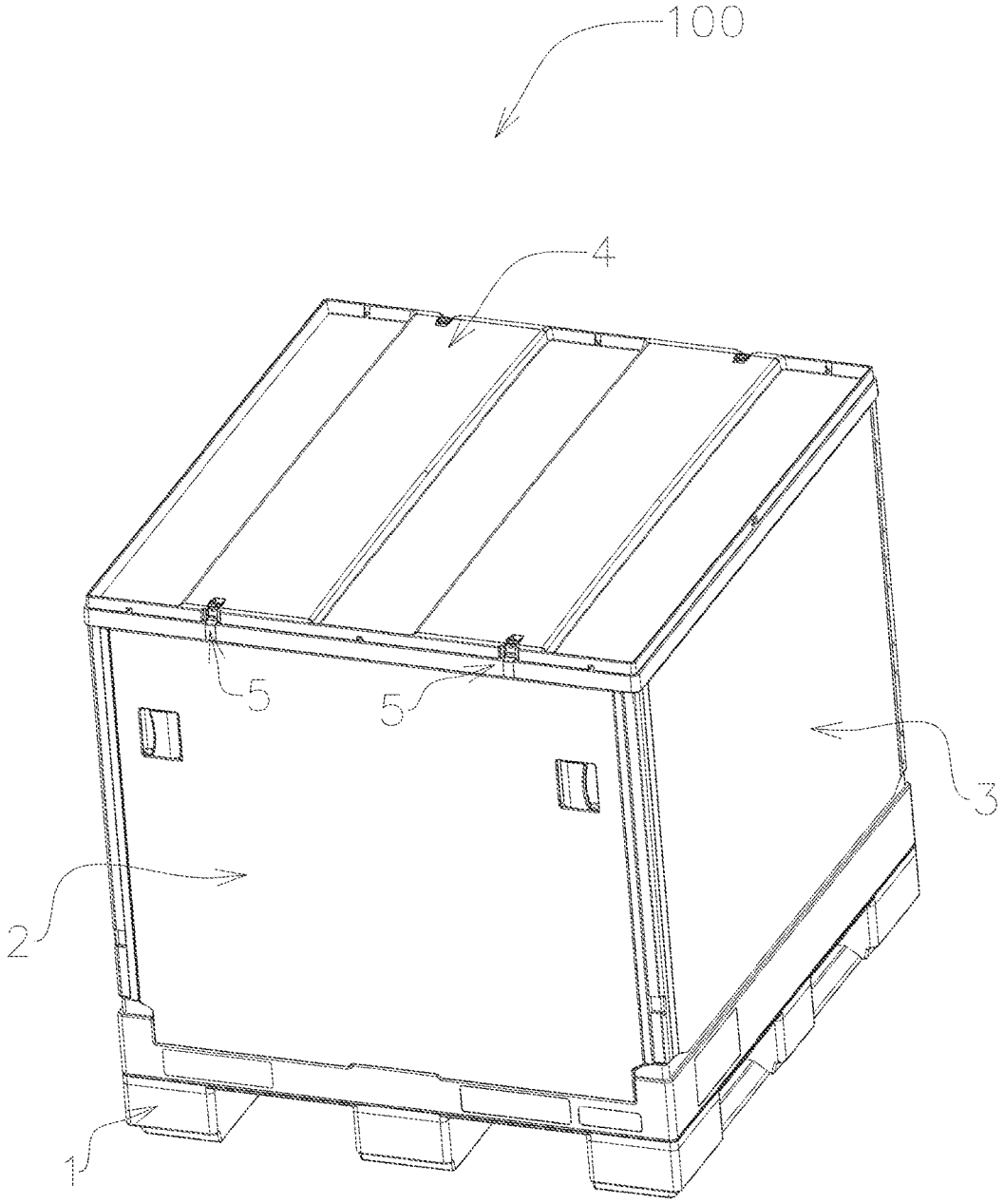
FIG. 1 is a perspective view of the container of the present invention.

Preferred embodiments of the present invention will now be described in detail with reference to the accompanying drawings in order to provide a clearer understanding of the objects, features and advantages of the present invention. It is to be understood that the embodiments shown in the drawings are not intended to limit the scope of the invention, but merely to illustrate the spirit of the invention.

The invention relates to a locking mechanism 5 for locking an upper cover 4 of a container to a side plate 2 of the container. The container 100 comprises a base 1, a pair of opposite side plates 2, a pair of opposite side plates 3, and an upper cover 4. The locking mechanism 5 comprises a locking element 50, a driving element 51, a side structure 52 formed on the side plate, a spring 53 and an upper cover structure 54 formed on the upper cover. Both the locking element 50 and driving element 51 are mounted in the upper cover structure 54. When the upper cover 4 is mounted on the side plate 2, the side plate structure 52 receives part of the locking element 50, therefore locking the upper cover 5 on the side plate 2.

Embodiment 1

As shown in FIGS. 1-15, a container 100 of the present embodiment comprises a base 1, a pair of opposite side plates 2, a pair of opposite side plates 3 and an upper cover 4. The locking mechanism 5 comprises a locking element 50, a driving element 51, a side plate structure 52 formed on the side plate, a spring 53 and the upper cover structure 54 formed on the upper cover. Both the locking element 50 and the driving element 51 are mounted in the upper cover structure 54, when the upper cover 4 is mounted on the side plate 2, the side plate structure 52 receives part of the locking element 50, thereby locking the upper cover 4 on the side plate 2.

FIG. 1 is a perspective view of the container of the present invention. As shown in FIG. 1, the container 100 comprises a base 1, a pair of opposite side plates 2, a pair of opposite side plates 3, and an upper cover 4. A locking mechanism 5 is provided between the upper cover 4 and the side plate 2.

Figure 2:
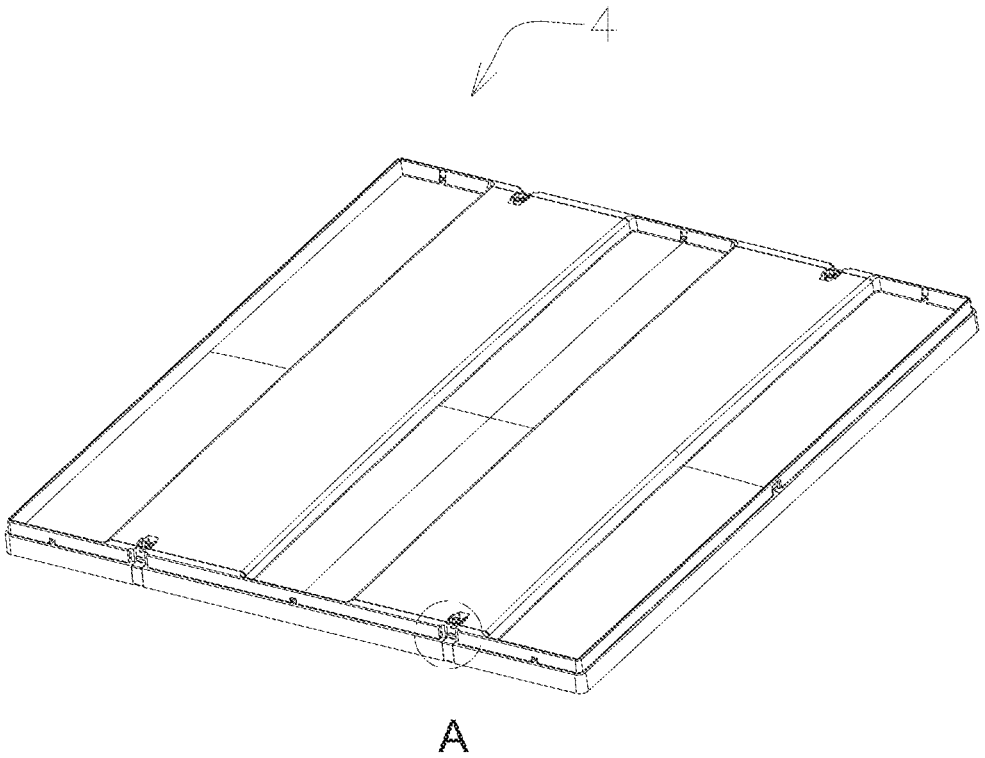
FIG. 2 is a perspective view of the upper cover of the container according to a first embodiment of the present invention.
Figure 3:
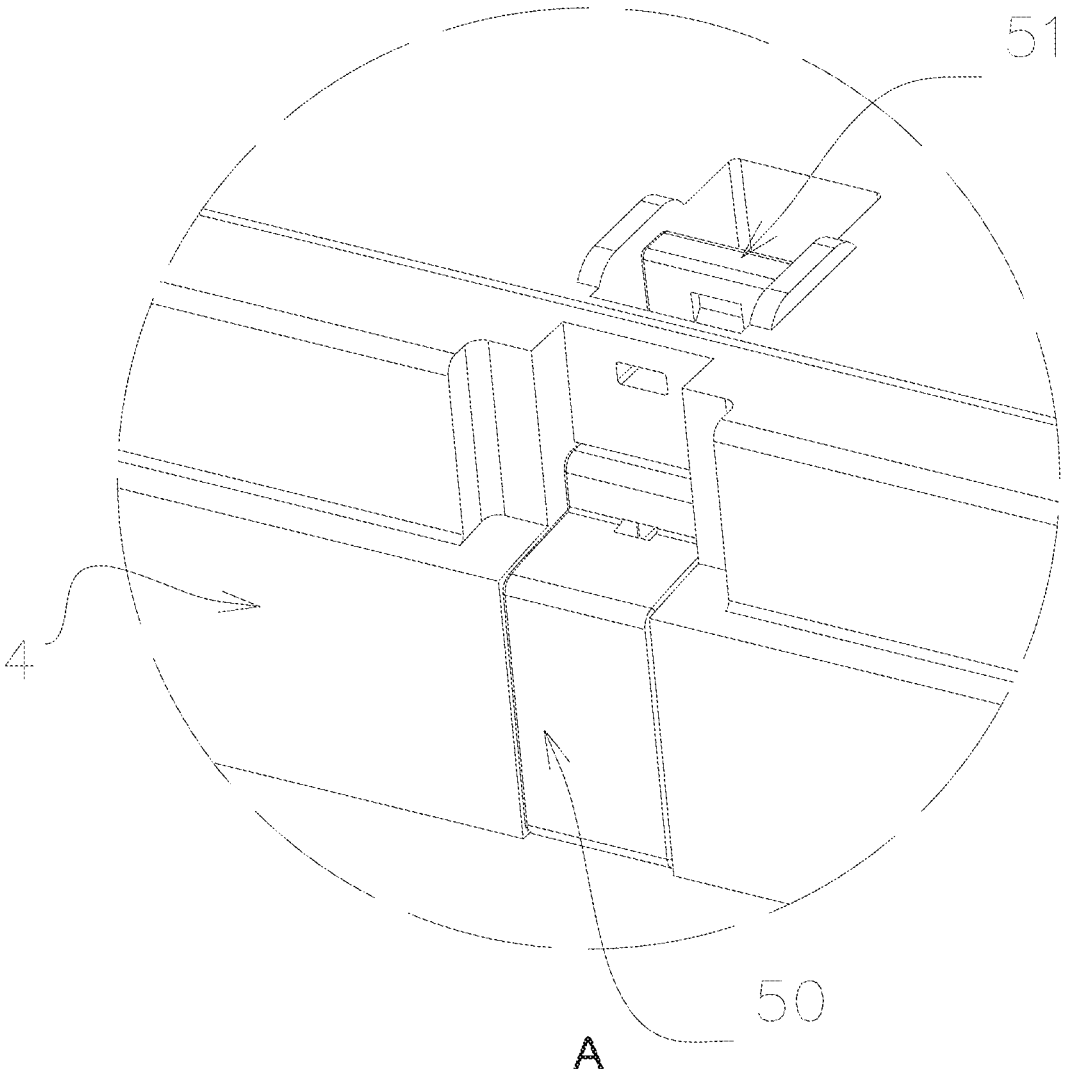
FIG. 3 is an enlarged view of part A in FIG. 2.
Figure 4:
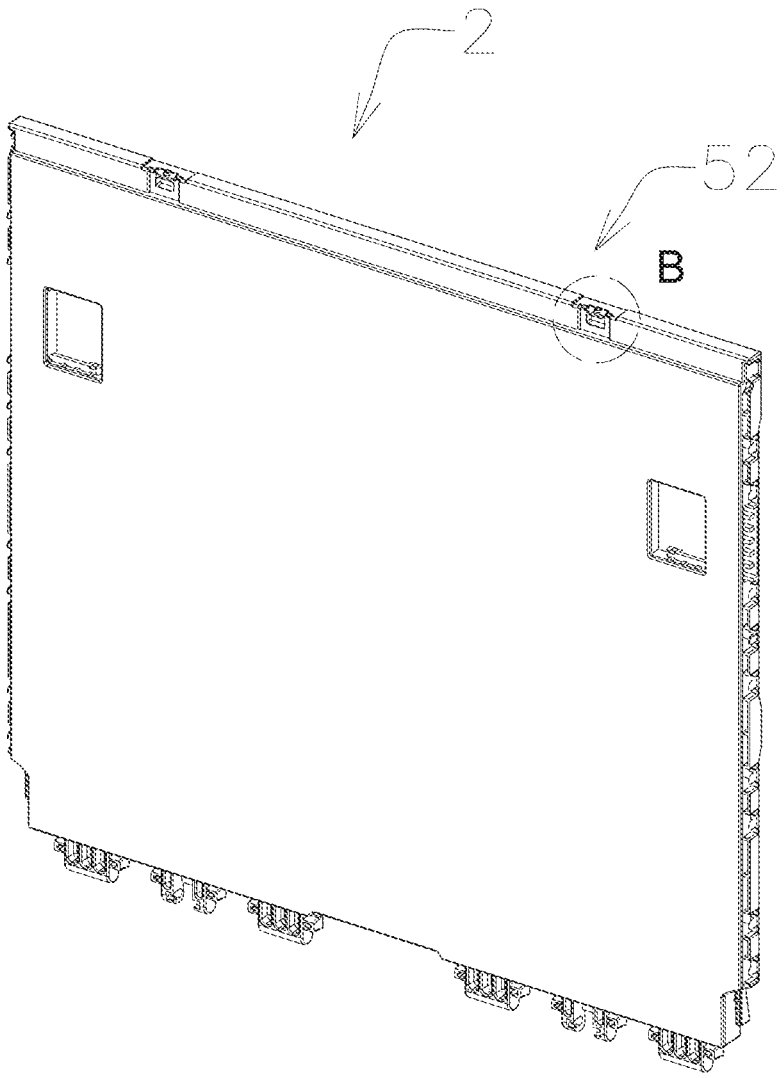
FIG. 4 is a perspective view of a side plate of the container according to the first embodiment of the present invention.
Figure 5:
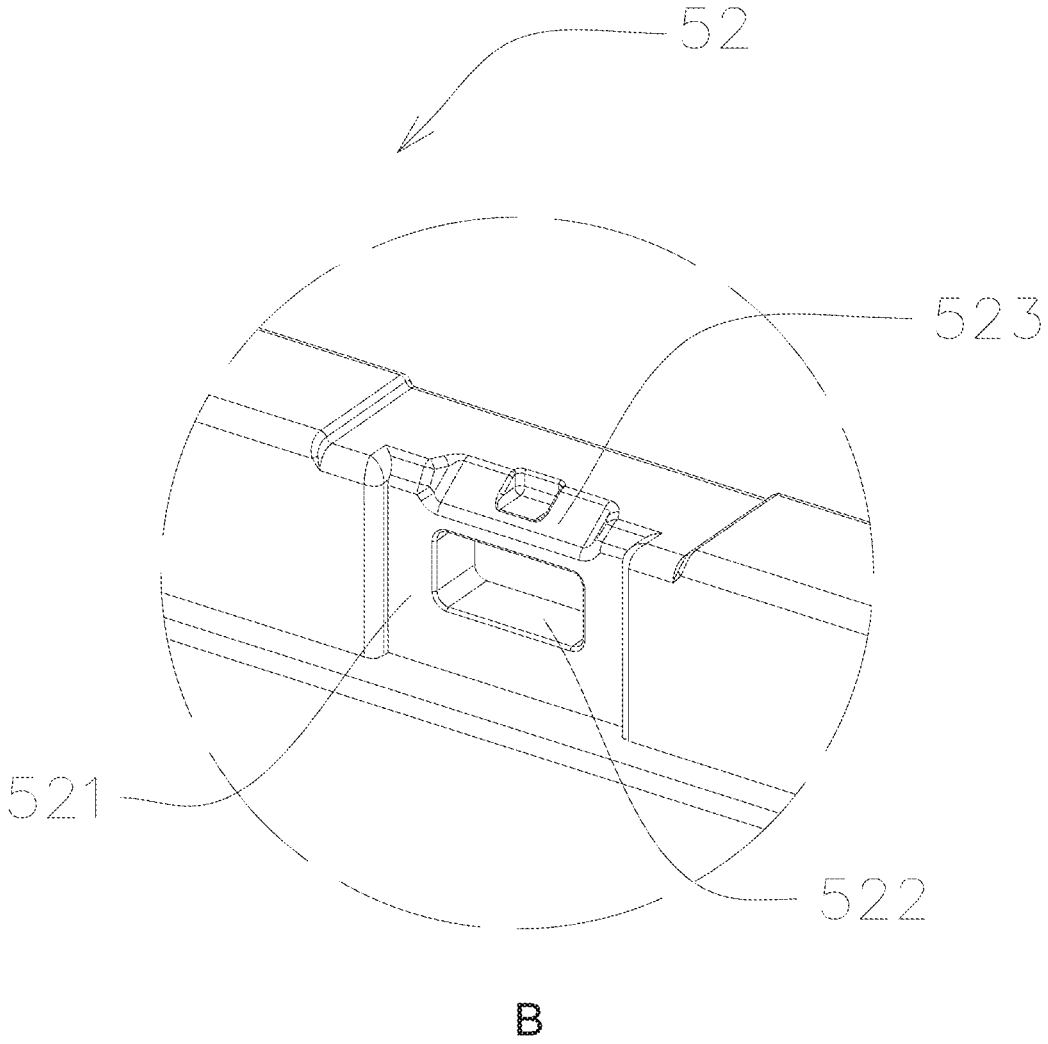
FIG. 5 is an enlarged view of part B in FIG. 4.
Figure 6:
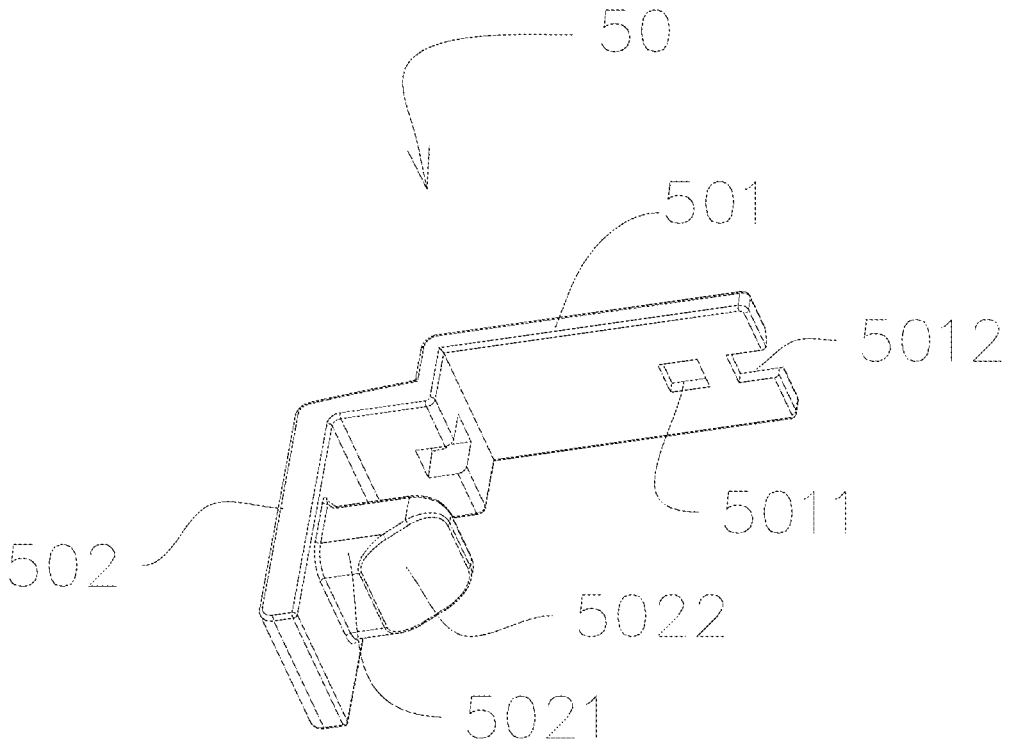
FIG. 6 is a perspective view of a driving element according to the first embodiment of the present invention.
Figure 7:
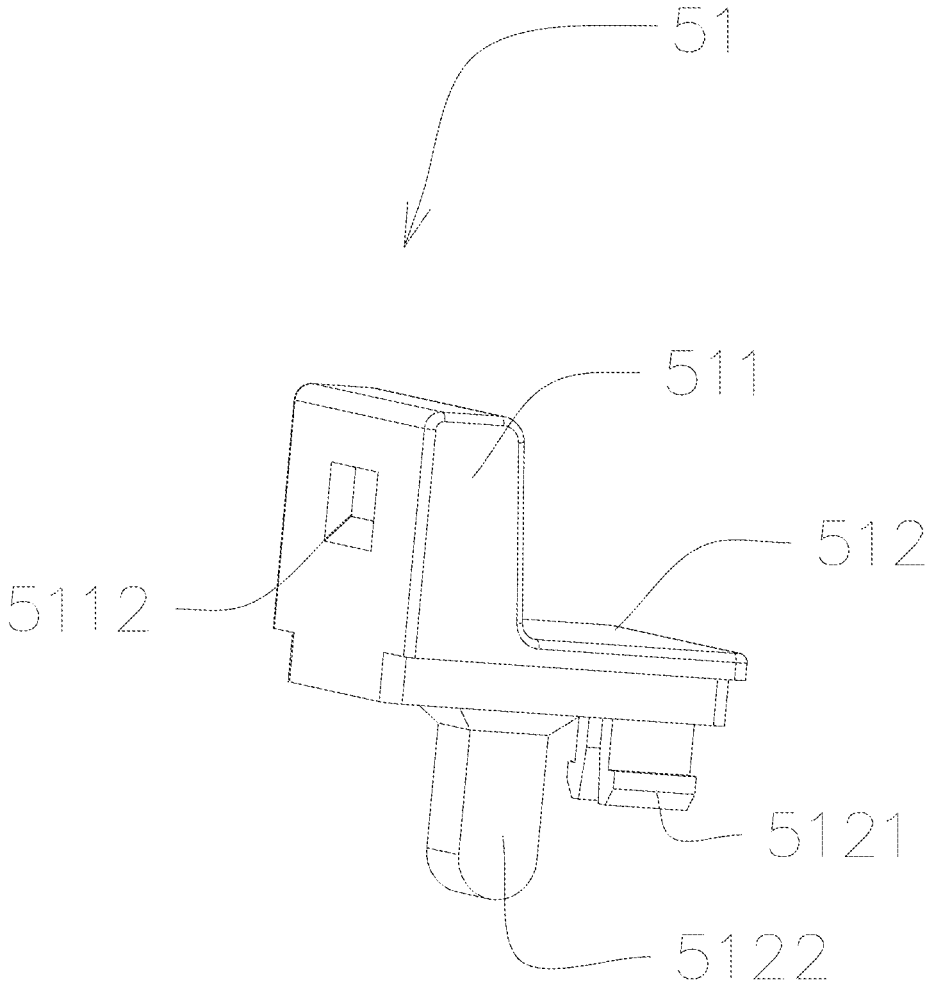
FIG. 7 is a perspective view of a locking element according to the first embodiment of the present invention.
Figure 8:
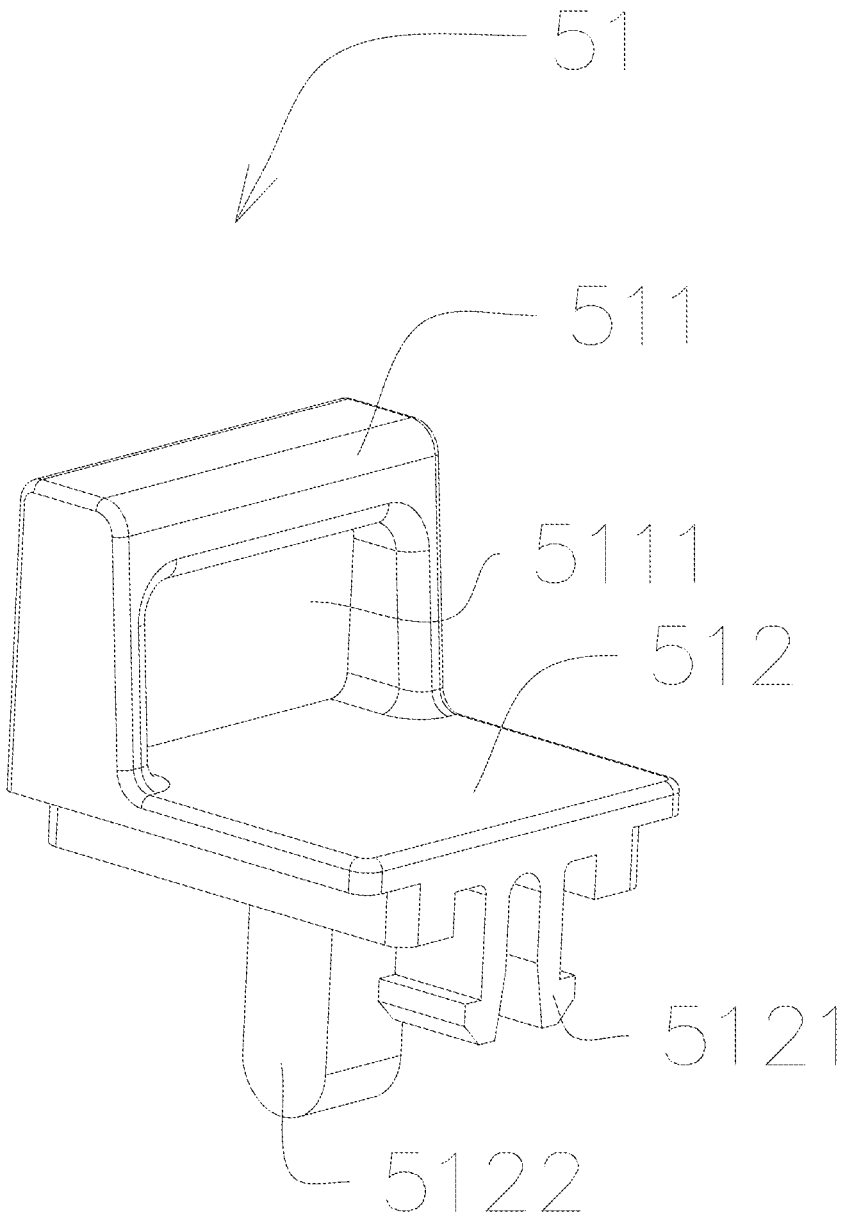
FIG. 8 is a perspective view of another locking element according to the first embodiment of the present invention.
Figure 9:
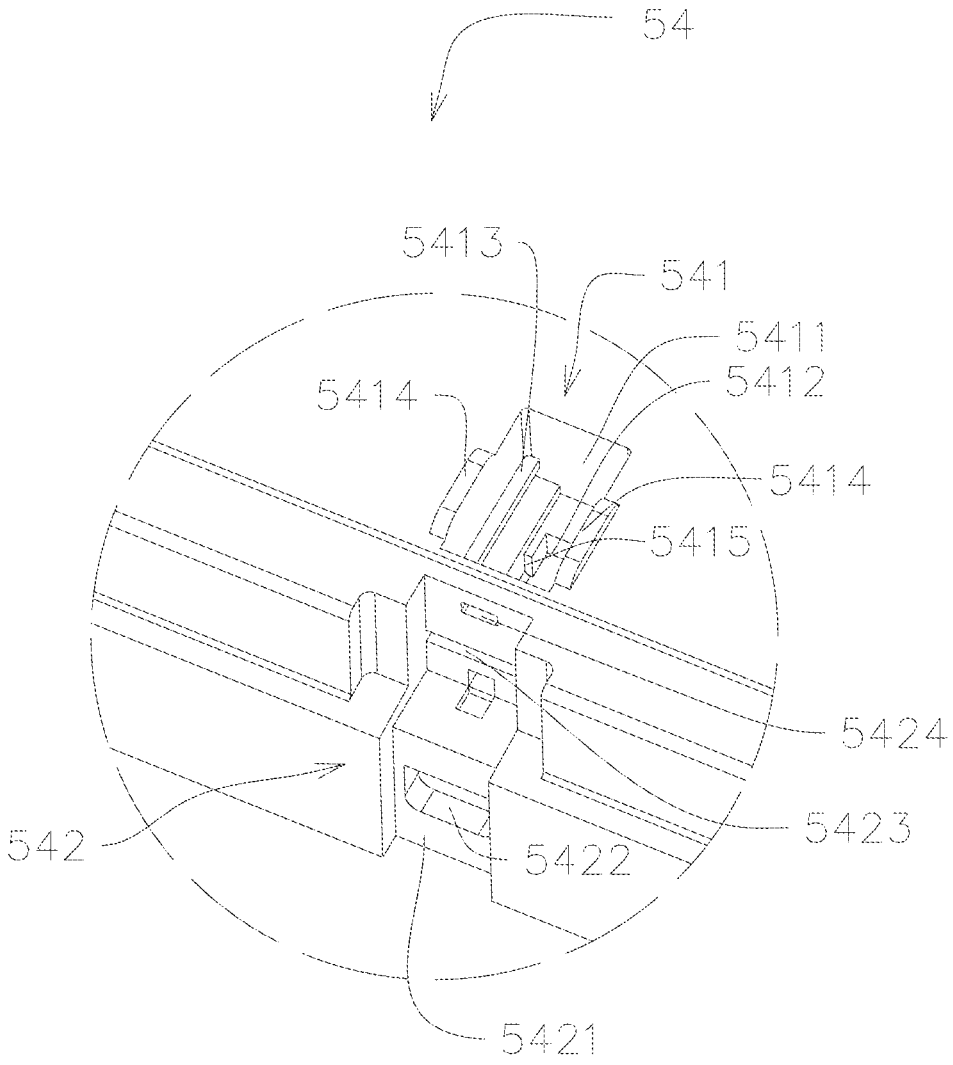
FIG. 9 is a perspective view of the upper cover structure according to the first embodiment of the present invention.

FIG. 2 is a perspective view of the upper cover 4 after the locking element 50 and driving element 51 of the locking mechanism 5 are mounted, and FIG. 3 is a perspective view of the side plate 2 of the container of the present invention, and FIG. 4 is an enlarged view of part A of the FIG. 2, and FIG. 5 is an enlarged view of part B of the FIG. 3, and FIG. 6 is a perspective view of the locking element 50, and FIG. 7 and FIG. 8 are perspective views of driving element 51. FIG. 9 is a perspective view of the upper cover structure 54 of the locking mechanism 5.

As shown in FIGS. 2~9, the locking mechanism 5 is composed of five components, which are respectively the locking element 50, the driving element 51, the side plate structure 52 on the side plate 2, the spring 53 and the upper cover structure 54 on the upper cover 4.

As shown in FIG. 6, the locking element 50 has a first portion 501 and a second portion 502. Upon mounting, the first portion 501 is located within the upper cover structure 54, and the second portion 502 is located within the side plate structure 52, and both of the first portion 501 and the second portion 502 have L-shaped body and are integrally connected by their respective short sides of the L-shaped body. The first portion 501 is provided with a top pillar receiving hole 5011 and a latch hole 5012, wherein the top pillar receiving hole 5011 is used for accommodating a spring top pillar 5122 and the latch hole 5012 is used for accommodating a latch 5121, which will be described in detail below. The second portion 502 has a locking head 5021, which extends integrally from the surface of the second portion 502 in a direction of the first portion 501. The locking head 5021 has an inclined plane 5022. When the locking element 50 is mounted on the cover 4 and the cover 4 is mounted on the side plate 2, the locking head 5021 exactly inserts into the lock hole 522, thereby locking the upper cover 4 tightly on the side plate 2, meanwhile when the upper cover 4 is mounted on the side plate, the inclined plane 5022 cooperates with the slope 523 of the side plate 2, so as to facilitate the locking head 5021 of the locking element lock to slip into the lock hole 5422, which will be described in detail below.

As shown in FIGS. 7~8, the driving element 51 is shaped like a seat, comprising a seat back 511 and a seat surface 512. A buckle position 5111 is provided on the side of the seat back 511 facing the seat surface 512, and an anti-theft slot 5112 is provided on the side of the seat back 511 facing back seat surface 512, and a latch 5121 and a top pillar 5122 are provided on the bottom of the seat surface 512, and both the latch 5121 and the top pillar 5122 integrally extends from the bottom of the seat surface 512, and the lower end of the top pillar 5122 has a cambered surface. Though the anti-theft slot 5112 is provided on the seat back 511 in the present embodiment, it should be understood by the skilled in the art that the anti-theft slot 5112 is not necessary if an anti-theft element is not required.

As shown in FIG. 5, the side plate structure 52 on the side plate 2 comprises a locking groove 521, a lock hole 522 and a slope 523. The locking groove 521 is located on the upper exterior of the side plate 2, and the lock hole 522 is located in the locking groove 521, and the slope 523 is located above the lock hole 522.

As shown in FIG. 9, the upper cover structure 54 comprises a surface portion 541 provided on the upper surface of the upper cover 4 and a side portion 542 provided on the side surface of the upper cover 4. In the present embodiment, an edge guard is provided around the periphery of the upper cover 4, and the side portion 542 is provided on the edge guard of the upper cover 4.

The surface portion 541 comprises a groove 5411, a spring slot 5412, a guide trail 5413, a casting lug 5414, and a step 5415. Wherein the groove 5411 is provided at the upper surface edge of the upper cover 4 for accommodating the driving element 51; and the spring slot 5212 is provided in the groove 5411 for mounting the spring 53; and the guide 5413 is provided on both sides inside the groove 5411 for facilitating the driving element 51 slipping into the groove 5411; and the casting lug 5414 is provided on both outside sides of the groove, so as to enclose the groove 5411 from both sides; and the step 5415 is provided in the spring slot 5412, for bearing against the end of the spring 53 and meanwhile leaving a space so that the top pillar 51 can enter into the spring slot 5412 and contact the spring 53.

In the present embodiment, the side portion 542 is provided on the edge guard of the upper cover 4. The side portion 542 comprises a locking element groove 5421, a locking hole 5422, a locking head hole 5423 and anti-theft hole 5424. The locking element groove 5421 is provided on the side surface of the upper cover 4, for accommodating the locking element 50; and the locking head hole 5422 is provided in the locking element groove 5421 and passes through the edge guard of the upper cover 4, so that when the locking element 50 is mounted in the locking element groove 5421 and the upper cover is mounted to the side plate 2, the locking head 5021 of the locking element 50 passes through the locking head hole 5422 and extends into the lock hole 522 of the side plate 2; and the locking element hole 5423 is located in the locking element groove 5421 above the lock hole 522, communicating with the groove 5411 of the surface portion 541, and when the locking element 50 is mounted on the upper cover 4, the first portion 501 of the locking element 50 passes through the locking element hole 5423 and extends into the groove 5411; and the anti-theft hole 5424 is used for accommodating the anti-theft element 6. However, it should be understood by the skilled in the art that if the anti-theft element 6 is not provided, it is not necessary to provide an anti-theft hole 5424 on the upper cover 4.

Though the locking head hole 5422 is used in the present embodiment, it should be understood by the skilled in the art that the locking head hole 5422 may also be instead by a locking head slot, which is provided on the lower edge of the edge guard.

Figure 10:
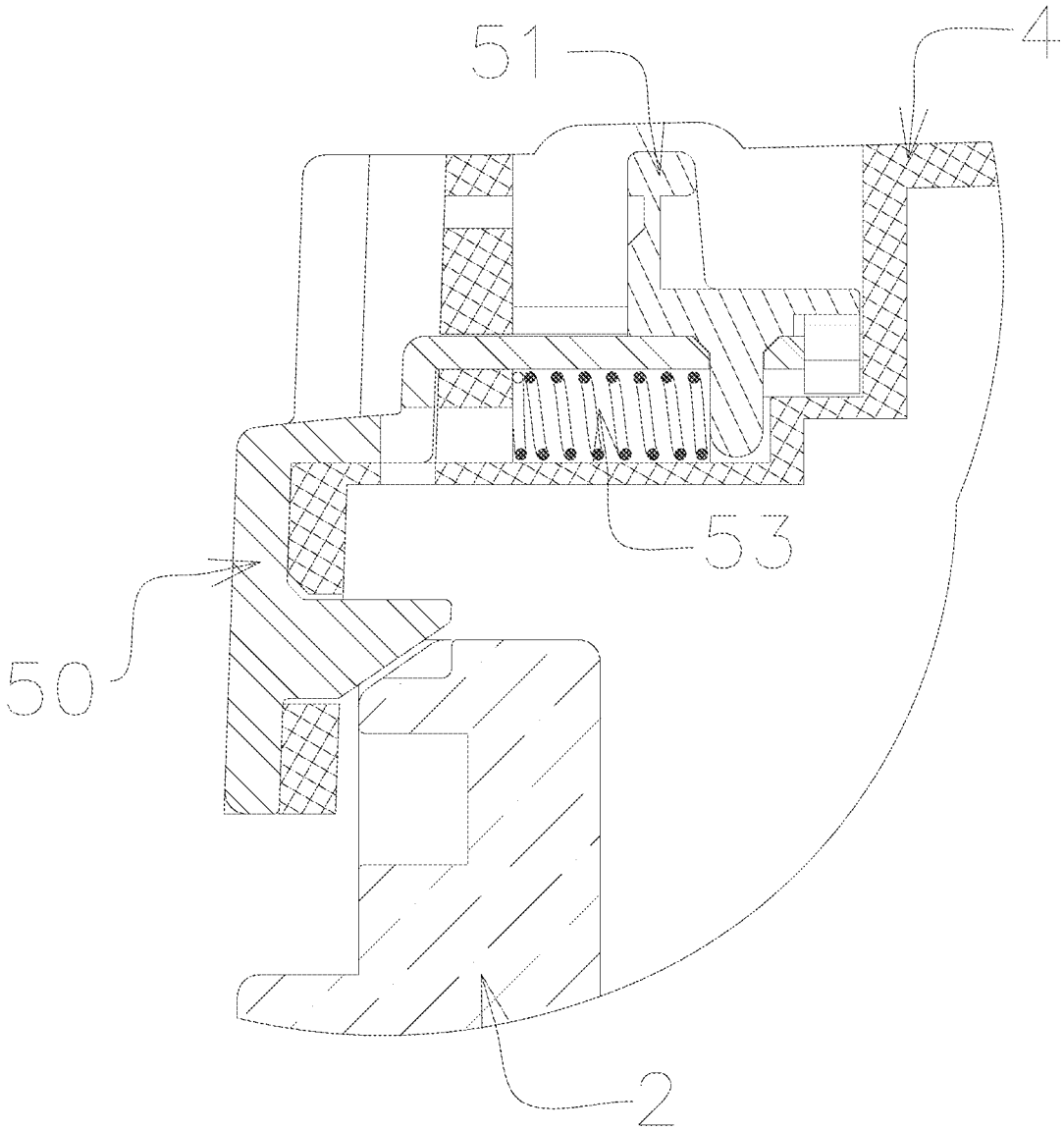
FIGS. 10~12 are cross-sectional views of the locking element during the mounting process according to the first embodiment of the present invention.
Figure 11:
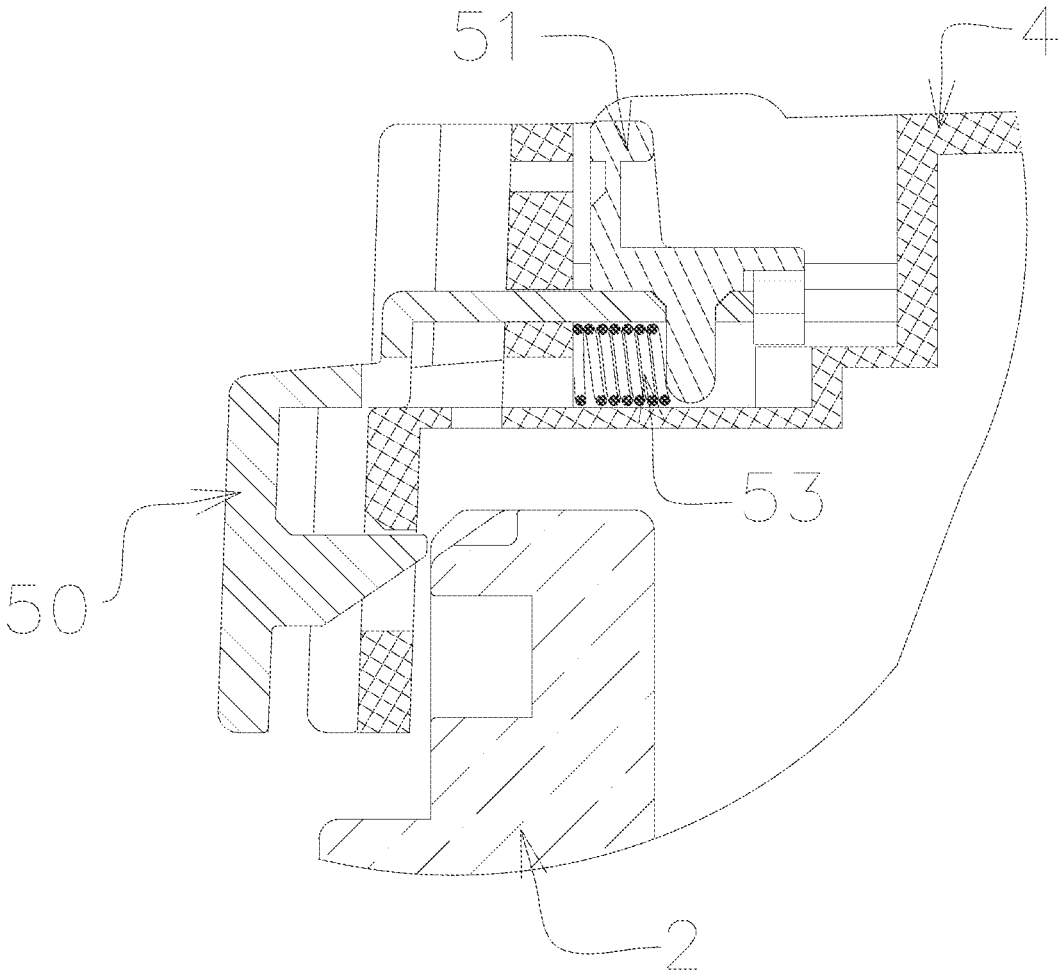
Figure 12:
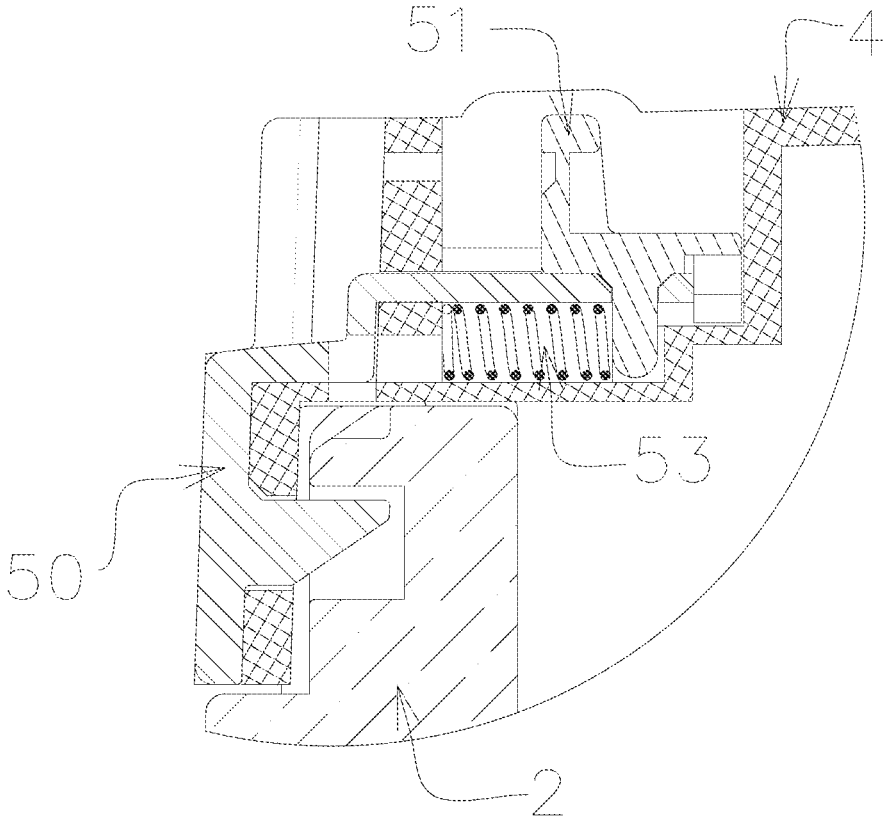

FIGS. 10~11 illustrate the process during which the locking element 50, driving element 51 and the upper cover 4 of the spring 53 are mounted to the side plate 2.

Upon mounting, the spring 53 is first mounted in the spring slot 5412, and then the first portion 501 of the locking element 50 is inserted from the exterior of the side plate 2 into the locking element hole 5423 and pushed to the end, and the driving element 51 is set into the groove 5411 from above. Since the end of the top pillar 5122 of the driving element 51 is designed with a cambered surface, when passing through the receiving hole 5011 and inserting into the end of the spring 53, it is able to provide a good guide function. At this time, the latch 5121 of the driving element 41 is buckled in the latch hole 5012, so as to restrict the driving element 51 from disengaging easily. The whole driving element 51 is placed in the groove 5411 of the upper cover 4, so that the distance for the driving element 51 to move outwardly is limited to a certain range.

Upon using, the upper cover 4 mounted with the locking element 50, driving element 41 and the spring 53 covers the container from top to bottom, and the inclined plane 5022 of the locking element 50 firstly contact the slope 523 of the side plate 2, and the lateral component force forces locking element 50 to move outwardly against the thrust of the spring 53 so that when the locking head 5021 of the locking element 50 arrives position of the lock hole 522 of the side plate 2, the locking head 5021 enters into the locking head hole 522 of the side plate 2 because of the spring release so as to locking the cover 4 to the side plate 2.

Upon unlocking, it is required to pull the locking element 51 outwardly and then drive the lock 5021 of the locking element 50 out of the lock hole 522 of the side plate 2, then the upper cover 4 is lifted up, so as to unlock the latch on the present side. The cover 4 is lifted up to a height and then be pushed towards the opposite side plate 2, the locking head 5021 of the locking element 50 of the opposite side plate 2 also can disengage from the lock hole 522 of the opposite side plate 2, thereby unlocking. In this way, the cover can be moved away by unlocking either side, which reduces the amount of labor increased by running to both sides to operate unlocking for the traditional cover.

Though the spring 53 is used in the present embodiment, it should be understood by the skilled in the art that the spring 53 may be alternated with other resilient element, such as elastomeric rubber, with which the purpose of the present invention will be achieved as well.

Preferably, an anti-theft element 6 is also provided on the locking mechanism 5 for preventing the upper cover from secretly opening.

Figure 13:
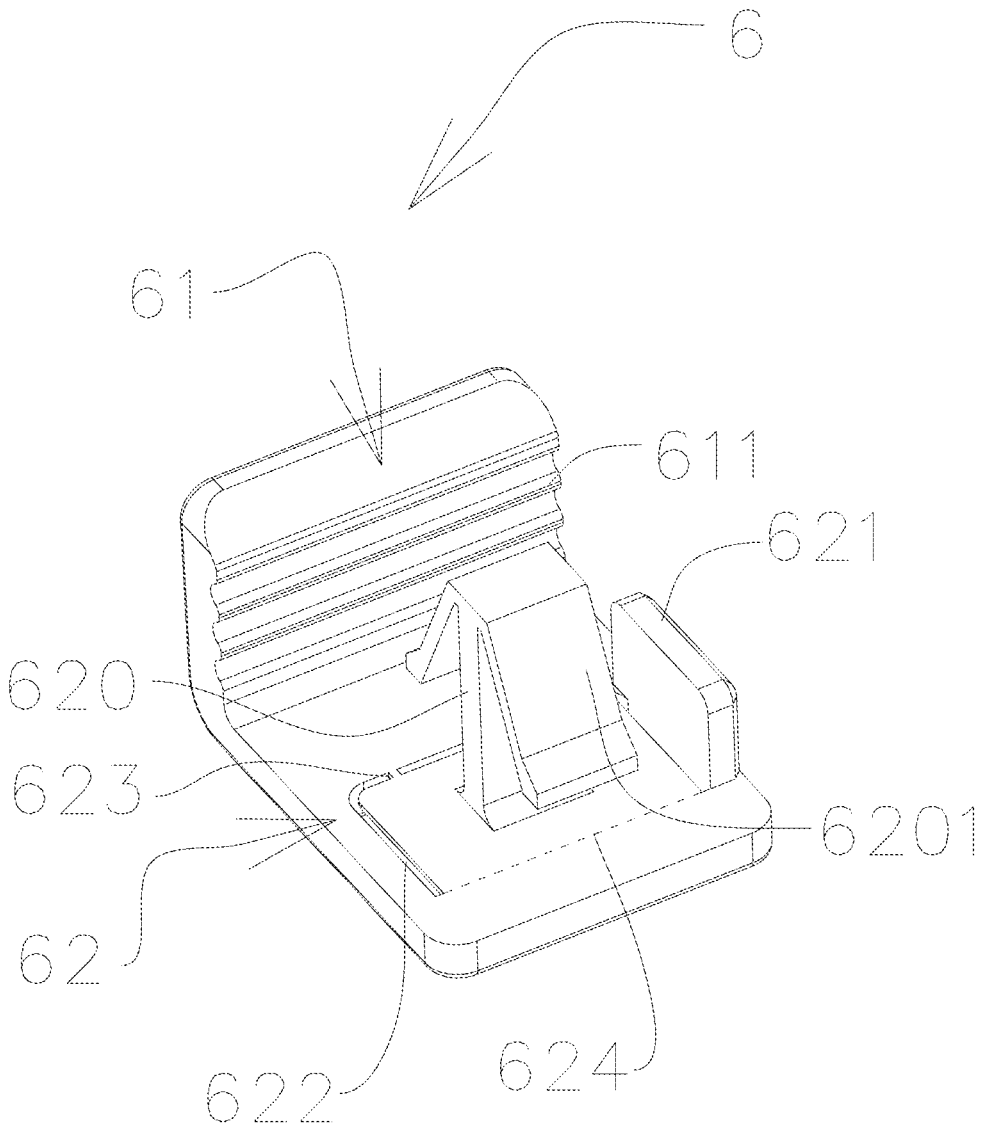
FIG. 13 is a perspective view of the anti-theft element according to the first embodiment of the present invention.
Figure 14:
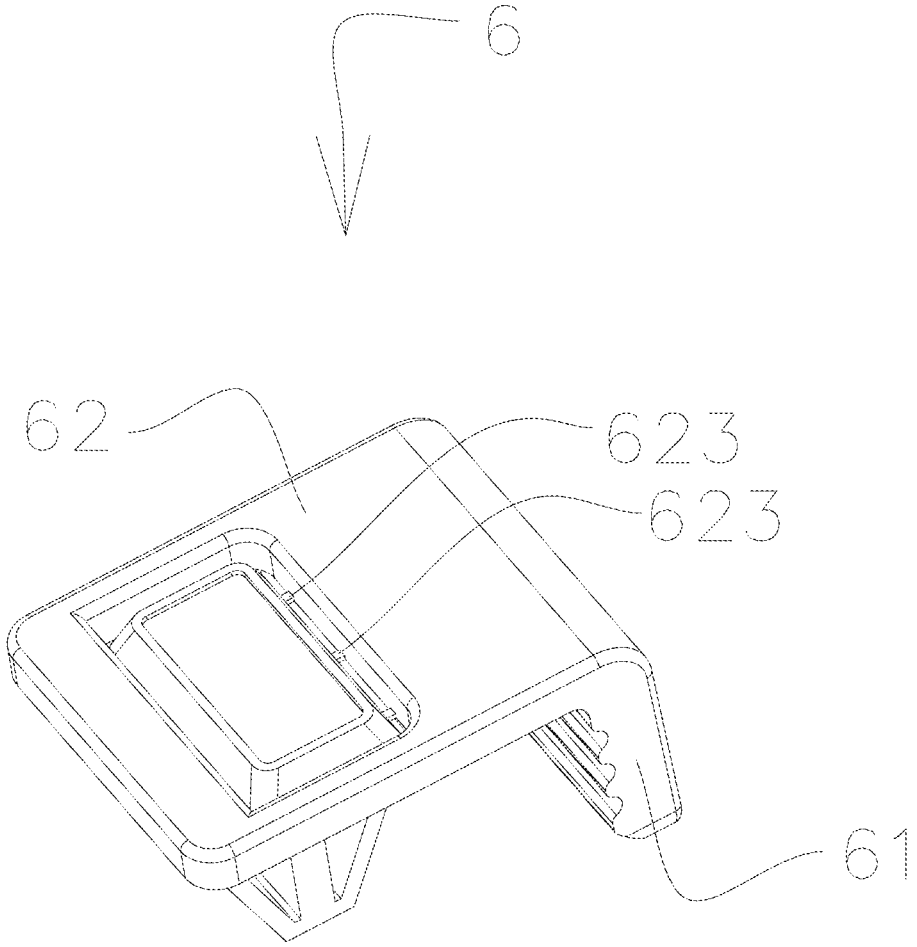
FIG. 14 is a perspective view of the anti-theft element according to the first embodiment of the present invention.

FIGS. 13~14 are perspective views of the anti-theft element 6. As shown in FIGS. 13~14, the anti-theft element 6 has a totally L-shaped body, which comprises a first portion 61 and a second portion 62. The first portion 61 and the second portion 62 are substantially perpendicular to each other and are integrally formed. Preferably, for convenient of operation, the first portion 61 is provided with a plurality of ribs 611, and the second portion 62 is provided with a rearward member 620 and a high rib 621 having a certain width, and an annular groove 622 which surrounds the rearward member 620, and one side of the annular groove 622 is provided with a thin rib 623 which is easily broken, and the other side is provided with a whole thin wall 624. The rearward member 620 has a V-shaped backrest 6201 and connects to the second portion 62 by the thin rib 623 and the thin wall 624. When the thin rib 623 is torn, the rearward member 620 is separated from the body and overturns to a certain degree with the thin well 624.

Figure 15:
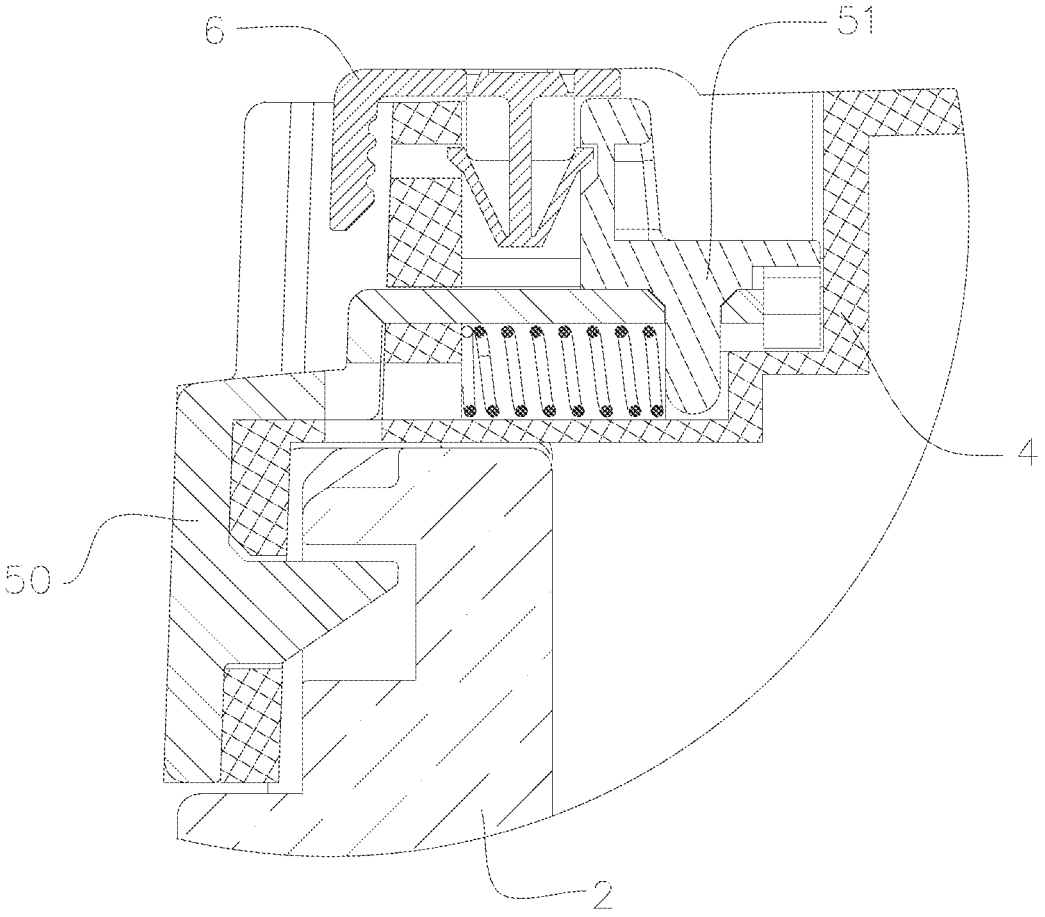
FIG. 15 is cross-sectional view of a locking mechanism provided with the anti-theft element according to the first embodiment of the present invention.
Figure 16:
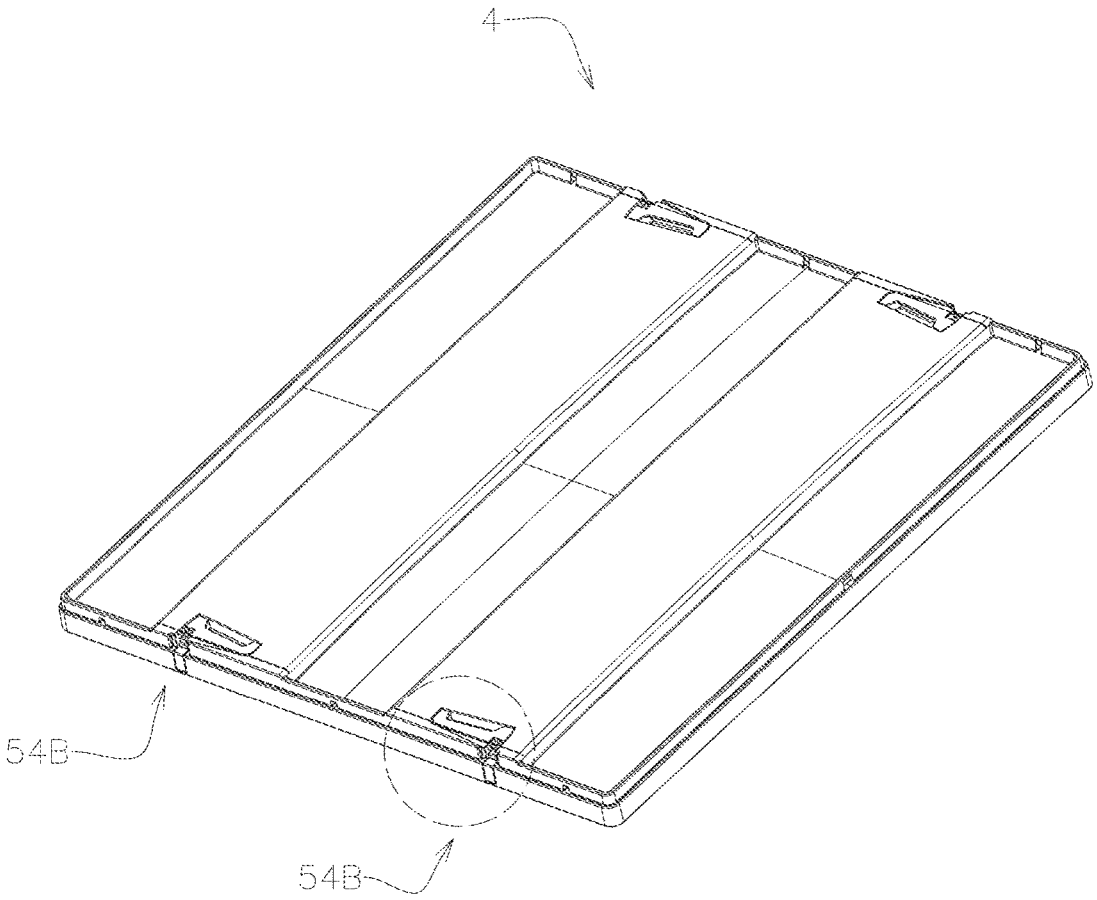
FIG. 16 is a perspective view of the upper cover according to a second embodiment of the present invention.
Figure 17:
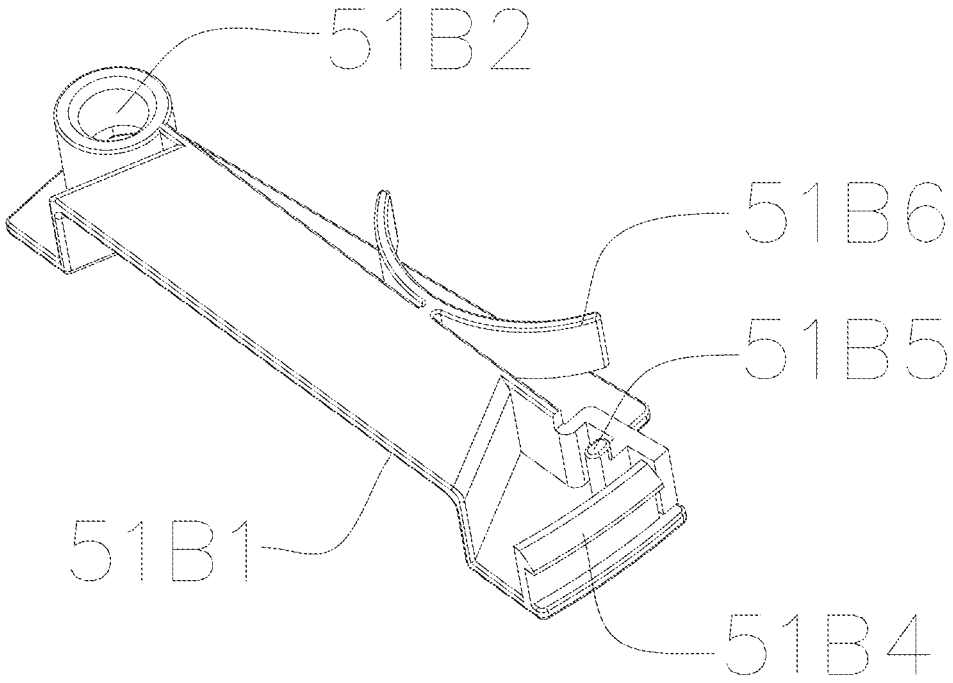
FIGS. 17~19 are a perspective views of a driving element according to the second embodiment of the present invention.
Figure 18:
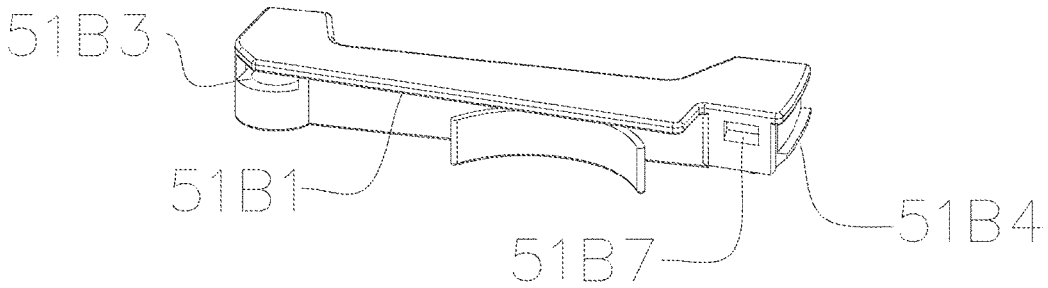
Figure 19:
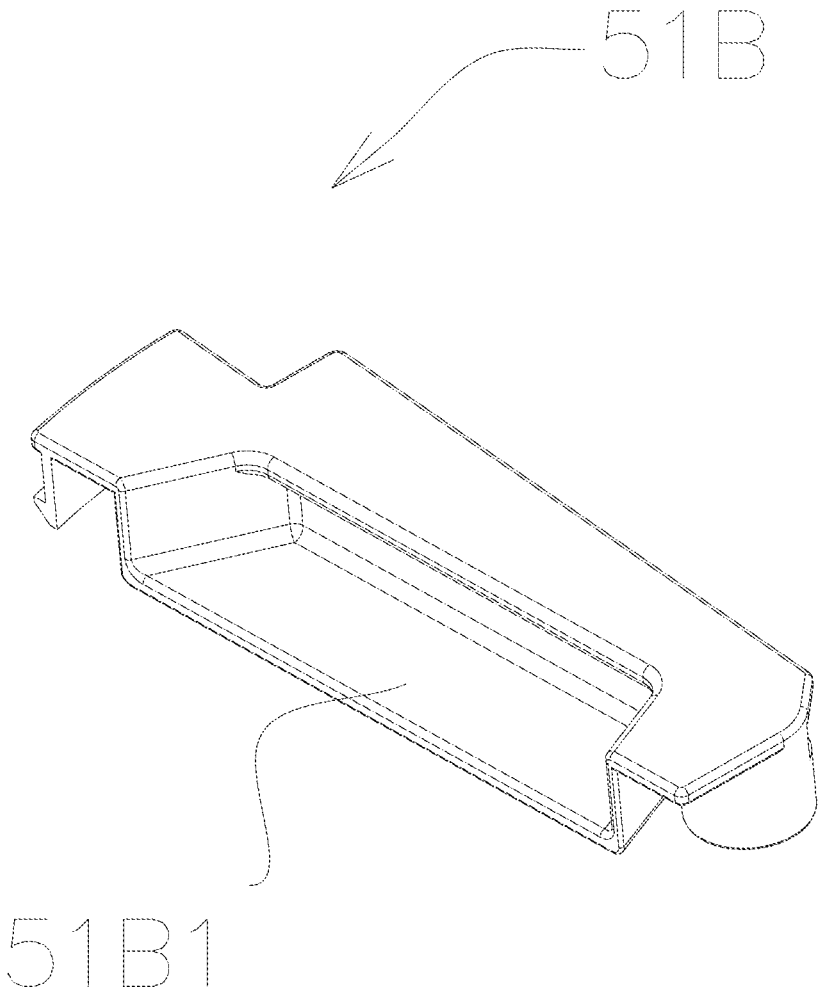

FIG. 15 is a cross-sectional view of the locking element 50 mounted with the anti-theft element 6. As shown in FIG. 15, when the anti-theft element 6 is used and the rearward member 620 is inserted into the movable space required for the driving element 51, the V-shaped backrests 6201 of the rearward member 6 are respectively buckled into the anti-theft hole 5424 of the upper cover 4 and the anti-theft slot 5112 of the driving element 51, so that the anti-theft element 6 cannot be easily taken away from the anti-theft slot 5112. The high rib 621 is inserted between the driving element 51 and upper cover 4, thereby restricting the movement of the driving element 51, so that the upper cover 4 cannot be disengaged from the side plate 2. At this moment, the protruding piece on the upper cover protects the anti-theft element 6 from being damaged by the accidental lateral force.

When the anti-theft element 6 need to be unlocked, the anti-theft element 6 is lifted from the ribs 611 of the first portion 61, and the thin rib 623 is torn, and when the first portion 61 is continued to be lifted up, the V-shaped backrest 6201 cannot be restored and disengaged from the anti-theft hole 5424 and the anti-theft slot 5112 because of a large deformation, or rotating the anti-theft element 6 around the axis of the anti-theft element 6 may also cause V-shaped backrest 6201 to being disengaged. No matter which means is used to unlock, it will cause thin rib 623 to be torn and cannot be reused so that a inspector can determine whether the upper cover 4 has been unlocked.

It should be understood that though the anti-theft element 6 is added in the present embodiment, the anti-theft element 6 may also not be provided according to the actual use. In this case the upper cover 4 is not necessary to be provided with an anti-theft hole 5424, and the driving element 51 is not necessary to be provided with an anti-theft slot 5112.

Embodiment 2

In the present embodiment, what is not described in detail is the same as that of the first embodiment.

As shown in FIGS. 16~23, the mainly difference between the present embodiment and the embodiment 1 is that in the present solution the locking element 50 is driven to move by rotating of the driving element.

Figure 20:
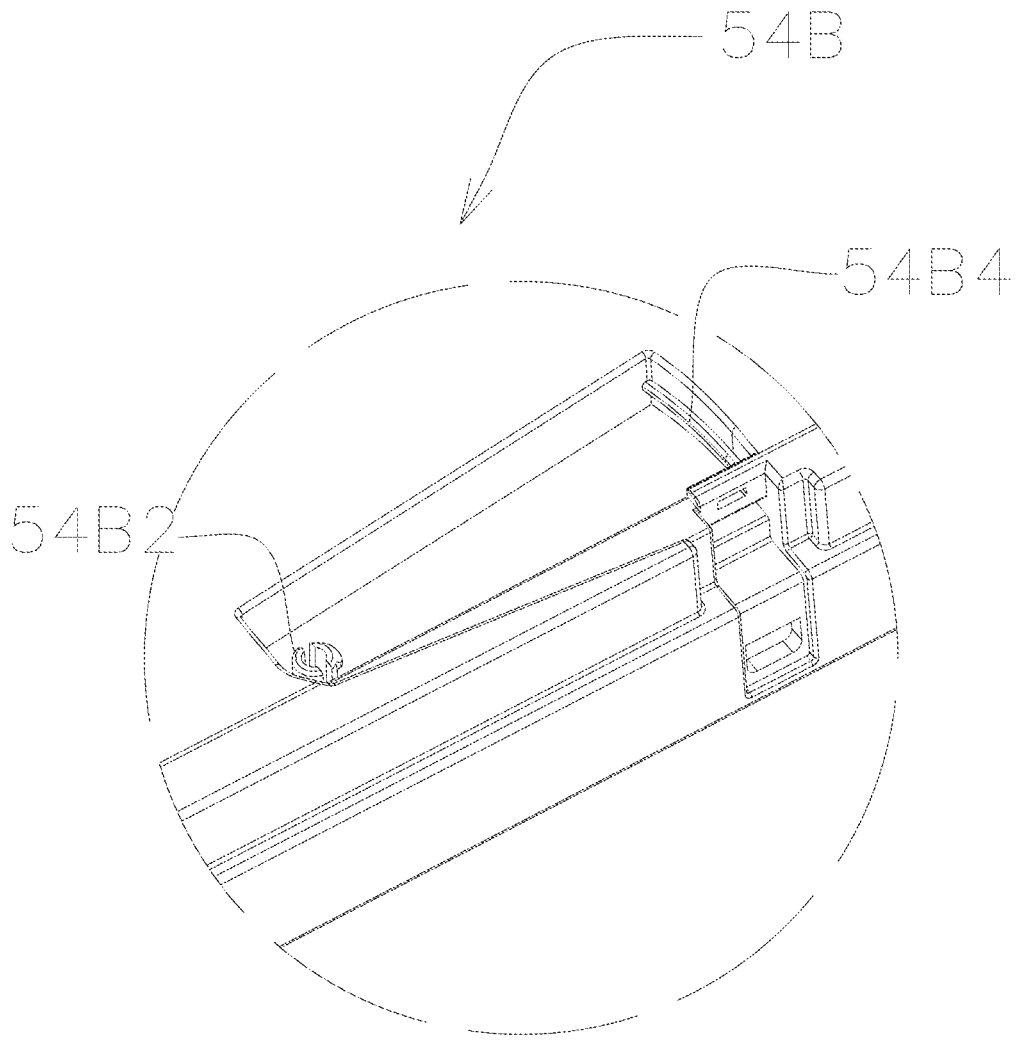
FIGS. 20-21 are perspective views of the upper cover structure according to the second embodiment of the present invention.
Figure 21:
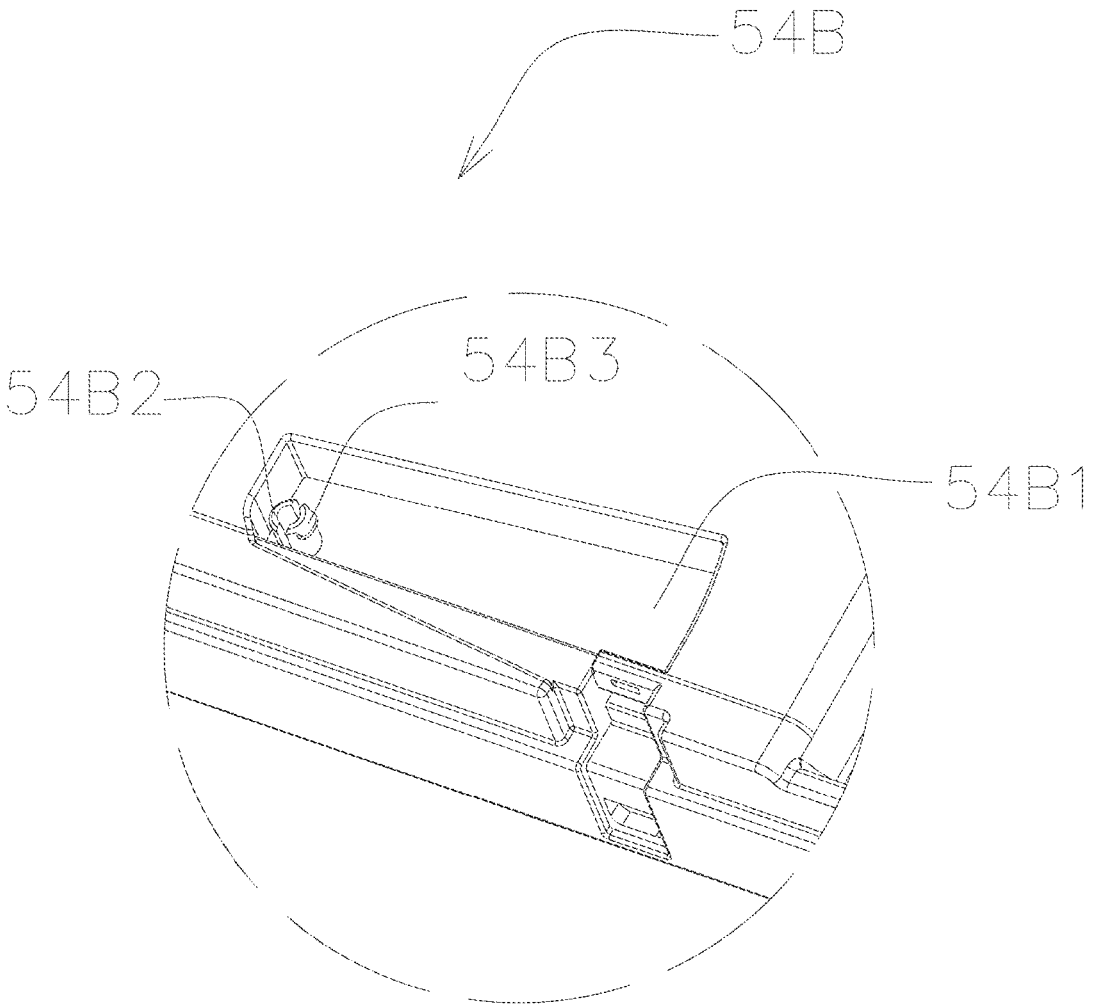
Figure 22:
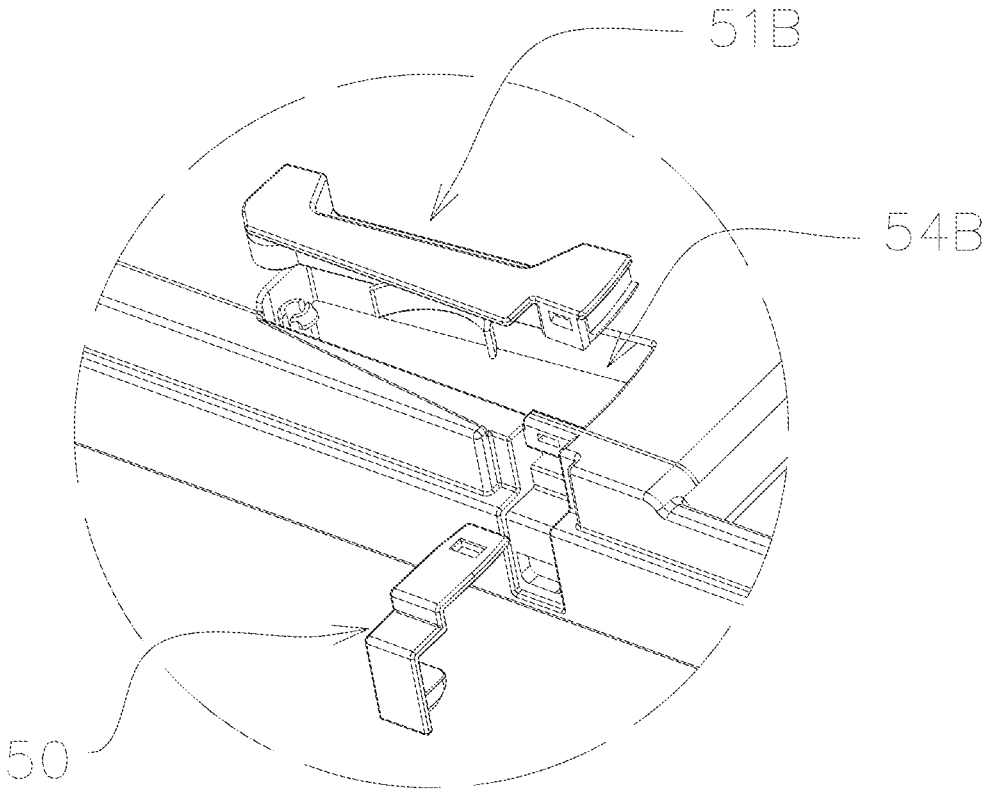
FIG. 22 is an exploded view of a locking mechanism according to the second embodiment of the present invention.
Figure 23:
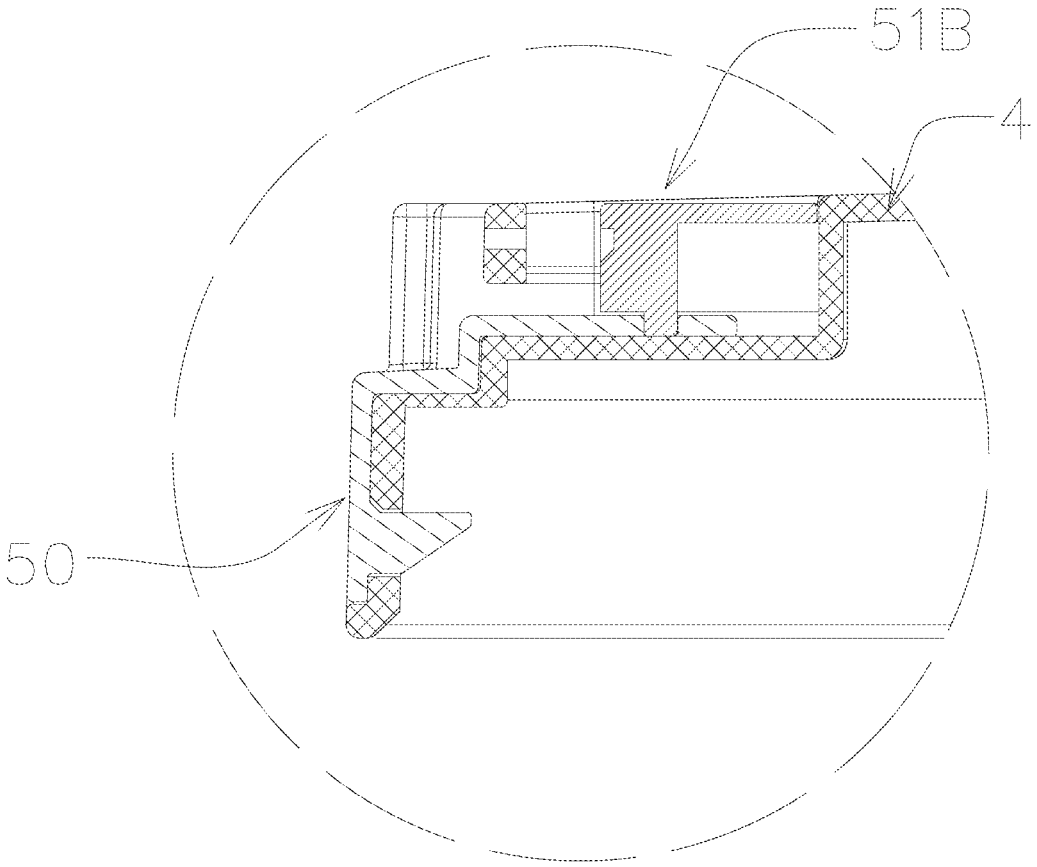
FIG. 23 is a cross-sectional view of the locking mechanism according to the second embodiment of the present invention.

As shown in FIGS. 20~22, the upper structure 54 of the upper cover 4 comprises a surface portion 54B provided on the upper surface of the upper cover and a side portion 542 provided on the side surface of the upper cover. In the present embodiment, the side portion of the upper cover is as same as that of the embodiment 1, which will not be described in detail herein.

As shown in FIGS. 16~19, the surface portion 54B comprises a groove 54B1, a shaft 54B2, a rotary stand 54B3, and a stand 54B4. Wherein, the shaft 54B2 is provided in the groove 54B1, and the rotary stand 54B3 is located on the top of the shaft 54B2, and the stand 54B4 is located in the groove 54B1.

As shown in FIGS. 20~22, driving element 51B is designed with a buckle portion 51B1 easy to operate, and one side of the buckle portion 51B1 is provided with a shaft hole 51B2, and a limit step 51B3 is provided above the shaft hole 51B2, and the other side of the buckle portion 51B1 is provided with a hook 51B4 and a top pillar 51B5, and the middle of the reverse side of the buckle portion 51B1 is provided with an integral shrapnel 51B6 for return after unlock operation. However, it should be understood by the skilled in the art that the integral shrapnel 51B6 may also be alternated by the other separated elastic element. Preferably, if the anti-theft element is also provided, the driving element 51B is also provided with an anti-theft buckle groove 51B7.

After the rotary shaft 54B2 of the upper cover 4 is installed into the shaft hole 51B2, the shaft stand 54B3 cooperates with the limit step 51B3, so as to restrict outward movement of the driving element 51B. After the driving element 51B is installed on the upper cover 4, the hook 51B4 cooperates with the stand 54B4 of the upper cover 4, so as to restrict the outward movement of the driving element 51B from the other side. The stand 54B4 and the hook 51B4 have an arc shape with the axis of shaft 54B2, so that the driving element 51B does not interfere with other part during operation.

The top pillar 51B5 is inserted into the locking element receiving hole 5011 of the locking element 50, and then drives the locking element 50 to move along the groove 54B1 of the upper cover 4. At this time the shrapnel 51B6 contacts the side wall of the groove 54B1 of the upper cover 4, so as to be able to drive the driving element 51 B1 to the initial position after being operated, thereby ensuring the locking element 50 to be always kept in a lockable station.

Though a shaft hole is provided in the driving element in the present embodiment, and the shaft is provided in the groove, however, it may be understood by the skilled in the art that it is also possible to provide a shaft role in the groove and to provide a shaft on the driving element. The object of the present invention will be achieved as well.

While the preferred embodiments of the present invention have been described in detail above, it will be understood by those skilled in the art that various changes and modifications can be made therein without departing from the above teachings of the present invention. These equivalents are also intended to be within the scope of the claims appended hereto.

What is claimed is:

1. A locking mechanism for locking an upper cover of a container to side plates of a container, which comprises a base, the upper cover and the side plates, the upper cover is provided with an edge guard, wherein the locking mechanism comprises a locking element, a driving element, a return element, a lock hole formed on an exterior of at least one of the side plates and a groove formed on the upper cover, wherein one end of the locking element is mounted in the groove, and the other end of the locking element is provided with a locking head, which passes through the edge guard and extends into the locking hole in a direction perpendicular to the side plates so as to securely lock the upper cover to the side plates, and the driving element is mounted in the groove and used to drive the locking element to be unlocked, and the return element is mounted in the groove and used to return the driving element after being unlocked.

2. The locking mechanism according to claim 1, wherein the upper cover is further provided with a locking element hole, through which the locking element connects to the driving element, and one end of the return element bears against the side wall of the groove of the upper cover, and the other end cooperates with the driving element.

3. The locking mechanism according to claim 1, wherein the driving element is provided with a top pillar;

the locking element is composed of a first portion and a second portion, which are integrally connected and perpendicular to each other, a top pillar receiving hole for accommodating the top pillar is provided on the first portion, and a locking head is provided on a side of the second portion facing to the side plate; and the upper cover is provided with a locking element hole, and the first portion of the locking element passes through the locking element hole and is partially located in the groove.

4. The locking mechanism according to claim 1, wherein the upper surface of the upper cover has an upwardly projecting portion, and the locking mechanism is provided on the side plates and the upper cover corresponding to the projecting portion.

5. The locking mechanism according to claim 1, wherein a locking head hole is provided at a position of the edge guard corresponding to the locking head hole, wherein the locking head passes through the locking hole and extends into the lock hole of the side plate when it is required to lock the upper cover to the side plates, so as to lock the upper cover to the side plates.

6. The locking mechanism according to claim 1, wherein the driving element is provided with an anti-theft slot, and the upper cover structure is provided with an anti-theft hole, and the locking mechanism is further provided with an anti-theft element, and the anti-theft element is partially mounted in the anti-theft groove, and partially mounted in the anti-theft hole.

7. The locking mechanism according to claim 1, wherein one end of the driving element is rotatably connected to the bottom of the groove, and the other end of the driving element cooperates with the locking element so that rotation of the driving element will drive the locking element to be unlocked.

8. The locking mechanism according to claim 7, wherein one of the driving element and the groove is provided with a shaft, and the other one of the driving element and the groove is correspondingly provided with a shaft hole, when the driving element is mounted in the groove, the shaft hole cooperates with the shaft, so as to drive the driving element to be rotated around the shaft and thus to be unlocked.

9. The locking mechanism according to claim 7, wherein the other end of the driving element is provided with a top pillar, and the locking element is provided with a top pillar receiving hole, and when the driving element is mounted in the groove, the top pillar is accommodated in the top pillar receiving hole, so as to connect the driving element and the locking element, and the return element is a resilient piece integrally formed on the side wall of the driving element toward outside of the container.

10. A container comprising a base, an upper cover and side plates, the upper cover is provided with an edge guard, and an upwardly projecting protrusion is provided on the upper surface of the upper cover, wherein the locking mechanism of claim 1 is provided on the side plates and the upper cover corresponding to the projecting portion.

11. The container according to claim 10, wherein two locking mechanisms are respectively provided on opposite sides of the container.

* * * * *